US011129456B2

(12) United States Patent
Epuechi

(10) Patent No.: US 11,129,456 B2
(45) Date of Patent: Sep. 28, 2021

(54) ROLLABLE LUGGAGE ASSEMBLY

(71) Applicant: Domithilla Epuechi, Irvington, NJ (US)

(72) Inventor: Domithilla Epuechi, Irvington, NJ (US)

( * ) Notice: Subject to any disclaimer, the term of this patent is extended or adjusted under 35 U.S.C. 154(b) by 359 days.

(21) Appl. No.: 16/224,898

(22) Filed: Dec. 19, 2018

(65) Prior Publication Data

US 2020/0196727 A1 Jun. 25, 2020

(51) Int. Cl.
*A45C 13/38* (2006.01)
*A45C 5/14* (2006.01)

(52) U.S. Cl.
CPC ..... *A45C 13/385* (2013.01); *A45C 5/14* (2013.01)

(58) Field of Classification Search
CPC ..... A45C 13/385; A45C 5/14; A45C 7/0045
See application file for complete search history.

(56) References Cited

U.S. PATENT DOCUMENTS 3,319,744 A * 5/1967 Smith ..... A45C 7/0045 190/108
4,036,336 A 7/1977 Burtley
D333,725 S 3/1993 Thomas
5,431,262 A * 7/1995 Rekuc ..... A45C 7/0045 190/108
7,014,020 B2 3/2006 Tamura
8,146,722 B1 * 4/2012 Moreno ..... A45C 13/42 190/18 A
8,282,113 B2 10/2012 Veal
9,314,076 B2 * 4/2016 Edme ..... A45C 5/14
2004/0178208 A1 * 9/2004 Leba ..... F25D 3/08 220/761
2005/0098402 A1 * 5/2005 Cohen ..... A45C 9/00 190/12 A
2006/0011641 A1 * 1/2006 Sanderson ..... A45C 7/0036 220/835
2008/0217130 A1 9/2008 Louis
2008/0308369 A1 * 12/2008 Louis ..... A45C 9/00 190/12 A
2009/0101461 A1 * 4/2009 LaTowsky ..... A45C 13/00 190/18 A
2011/0247910 A1 * 10/2011 Darvish ..... A45C 13/008 220/324
2013/0175129 A1 * 7/2013 Rankin ..... A45C 5/14 190/18 A (Continued)

FOREIGN PATENT DOCUMENTS

WO WO2008071798 6/2008

*Primary Examiner* — John K Fristoe, Jr.
*Assistant Examiner* — Justin Caudill

(57) ABSTRACT

A rollable luggage assembly for piggybacking a second suitcase on a first suitcase includes a plurality of first rollers that is coupled to a bottom of the first suitcase. A first handle is selectively extensible from the first suitcase so that the first handle is positioned above and perpendicular to a top of the first suitcase. The first handle is configured to be grasped in a hand of a user to urge the first suitcase to roll across a surface. A plate, which is coupled to and is selectively extensible from the bottom of the first suitcase, is selectively positionable in a retracted configuration, wherein the plate is stowed adjacent to the bottom, and an extended configuration, wherein the plate extends from and is perpendicular to a front of the first suitcase. The plate is configured to position an article so that the article is locomoted with the first suitcase.

17 Claims, 6 Drawing Sheets

(56) References Cited

U.S. PATENT DOCUMENTS

| | | | | |
|---|---|---|---|---|
| 2014/0190780 | A1 | 7/2014 | Blazure | |
| 2015/0114777 | A1* | 4/2015 | Edme ..... | A45C 13/42<br>190/18 A |
| 2015/0208776 | A1 | 7/2015 | Bennett | |
| 2016/0309867 | A1 | 10/2016 | Oberg | |

* cited by examiner

ROLLABLE LUGGAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to luggage assemblies and more particularly pertains to a new luggage assembly for piggybacking a second suitcase on a first suitcase.

BRIEF SUMMARY OF THE INVENTION

An embodiment of the disclosure meets the needs presented above by generally comprising a plurality of first rollers that is coupled to a bottom of a first suitcase. A first handle is selectively extensible from the first suitcase so that the first handle is positioned above and perpendicular to a top of the first suitcase. The first handle is configured to be grasped in a hand of a user to urge the first suitcase to roll across a surface. A plate, which is coupled to and is selectively extensible from the bottom of the first suitcase, is selectively positionable in a retracted configuration, wherein the plate is stowed adjacent to the bottom, and an extended configuration, wherein the plate extends from and is perpendicular to a front of the first suitcase. The plate is configured to position an article so that the article is locomoted with the first suitcase.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
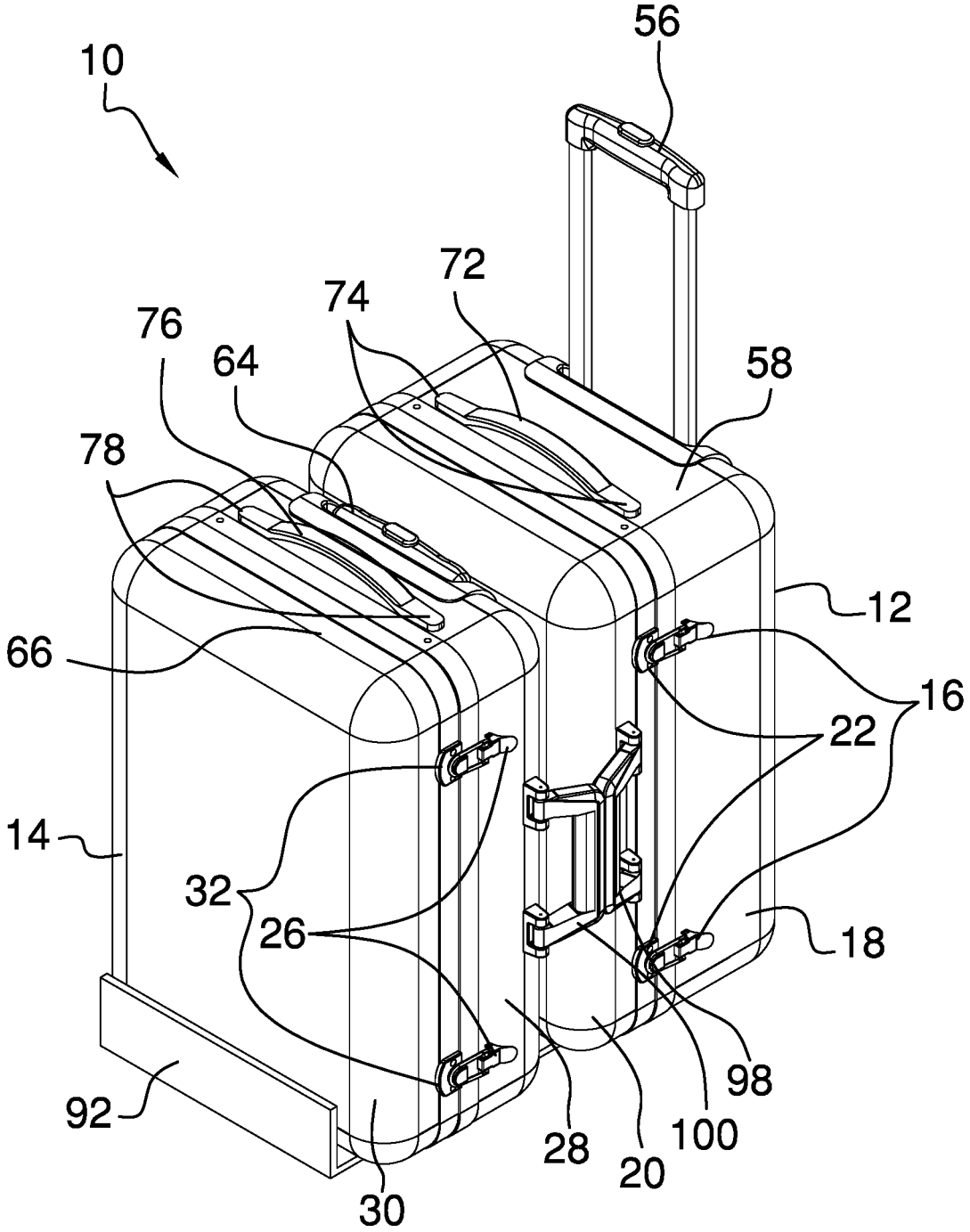
FIG. 1 is an isometric perspective view of a rollable luggage assembly according to an embodiment of the disclosure.

With reference now to the drawings, and in particular to FIGS. 1 through 6 thereof, a new luggage assembly embodying the principles and concepts of an embodiment of the disclosure and generally designated by the reference numeral 10 will be described.

As best illustrated in FIGS. 1 through 6, the rollable luggage assembly 10 generally comprises a first suitcase 12 and a second suitcase 14. The first suitcase 12 and the second suitcase 14 are clamshell type.

Figure 3:
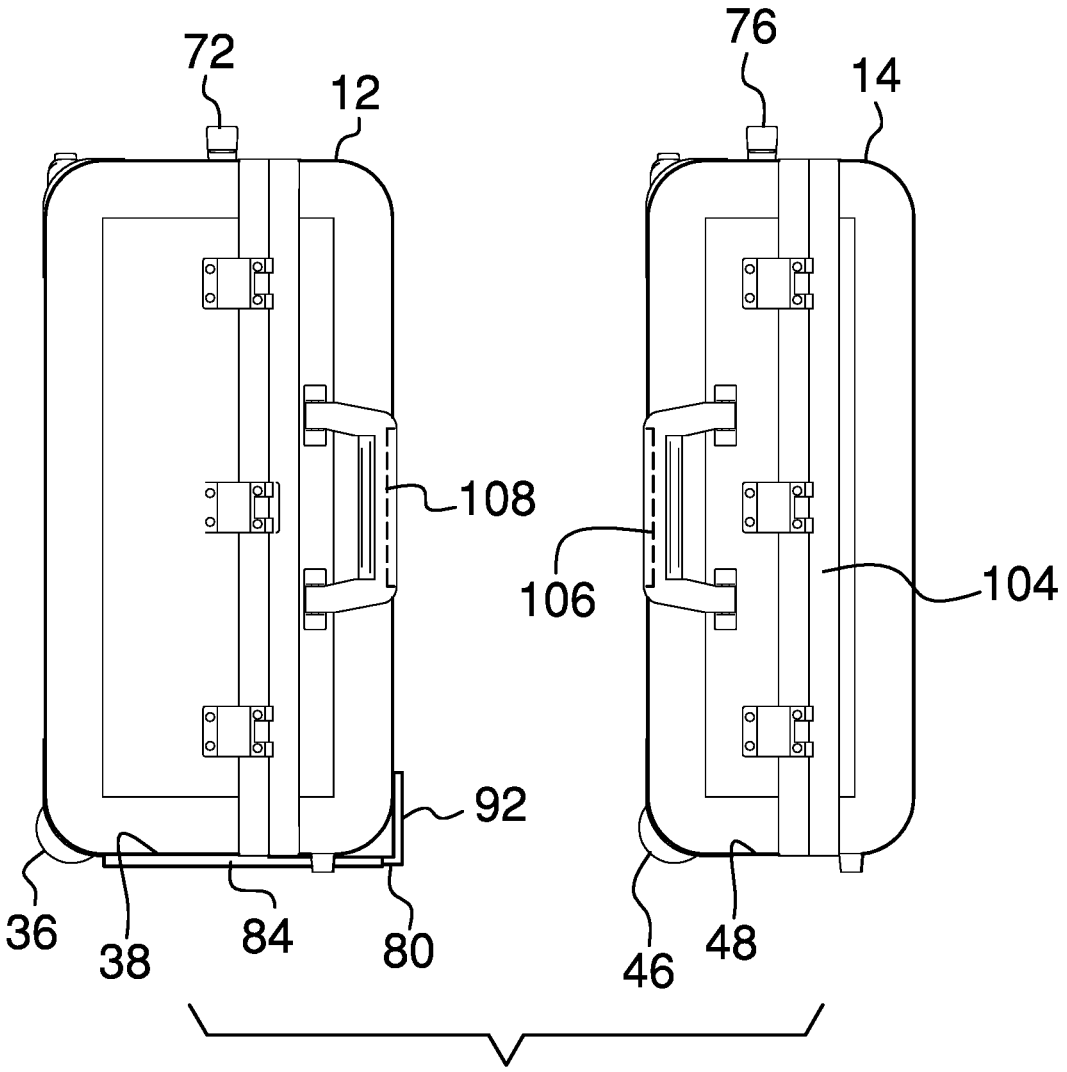
FIG. 3 is a side view of an embodiment of the disclosure.

As shown in FIG. 3, a plurality of first fasteners 16 is coupled to a lower section 18 of the first suitcase 12. The lower section 18 is hingedly coupled to an upper section 20 of the first suitcase 12. A plurality of second fasteners 22 is coupled to the upper section 20 of the first suitcase 12. The second fasteners 22 are complementary to the first fasteners 16 so that each second fastener 22 is positioned to selectively couple to an associated first fastener 16 to couple the upper section 20 to the lower section 18. The second fastener 22 and the associated first fastener 16 comprise a first toggle latch 24.

As shown in FIG. 3, a plurality of third fasteners 26 is coupled to a bottom section 28 of the second suitcase 14. The bottom section 28 is hingedly coupled to an upward section 30 of the second suitcase 14. A plurality of fourth fasteners 32 is coupled to the upward section 30 of the second suitcase 14. The fourth fasteners 32 are complementary to the third fasteners 26 so that each fourth fastener 32 is positioned to selectively couple to an associated third fastener 26 to couple the upward section 30 to the bottom section 28. The fourth fastener 32 and the associated third fastener 26 comprises a second toggle latch 34.

Figure 4:
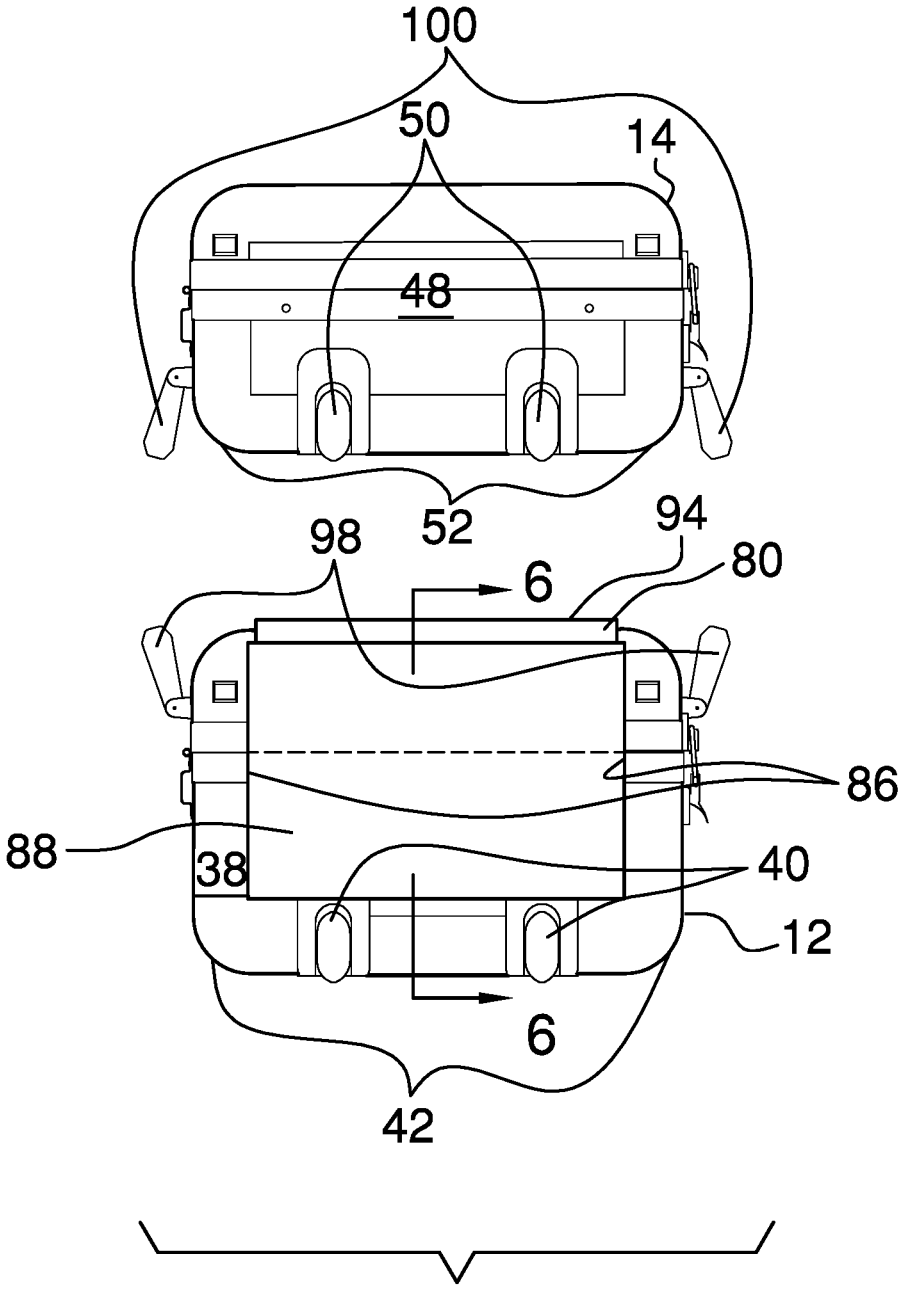
FIG. 4 is a bottom view of an embodiment of the disclosure.
Figure 5:
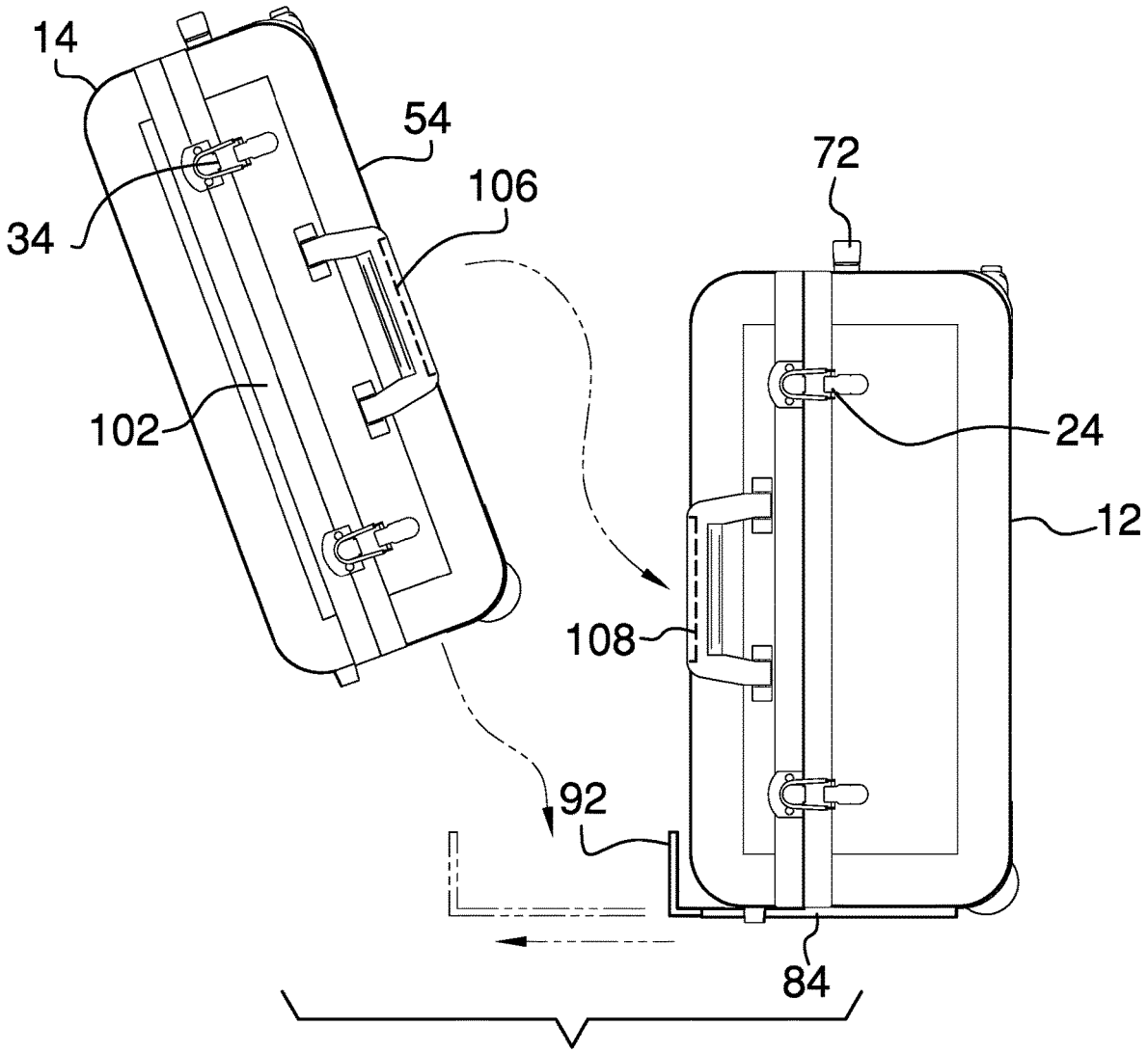
FIG. 5 is an in-use view of an embodiment of the disclosure.

As shown in FIG. 4, a plurality of first rollers 36 is coupled to a bottom 38 of the first suitcase 12. The plurality of first rollers 36 comprises a pair of first wheels 40. The first wheels 40 are coupled singly proximate to bottom corners 42 and to a back 44 of the first suitcase 12. A plurality of second rollers 46 is coupled to a lower face 48 of the second suitcase 14. The plurality of second rollers 46 comprises a pair of second wheels 50. The second wheels 50 are coupled singly proximate to lower face corners 52 and to a rear face 54 of the second suitcase 14.

A first handle 56 is coupled to and is selectively extensible from the back 44 of the first suitcase 12 so that the first handle 56 is positioned above and perpendicular to a top 58 of the first suitcase 12. The first handle 56 is configured to be grasped in a hand of a user to urge the first suitcase 12 to roll on the first rollers 36 across a surface.

Figure 2:
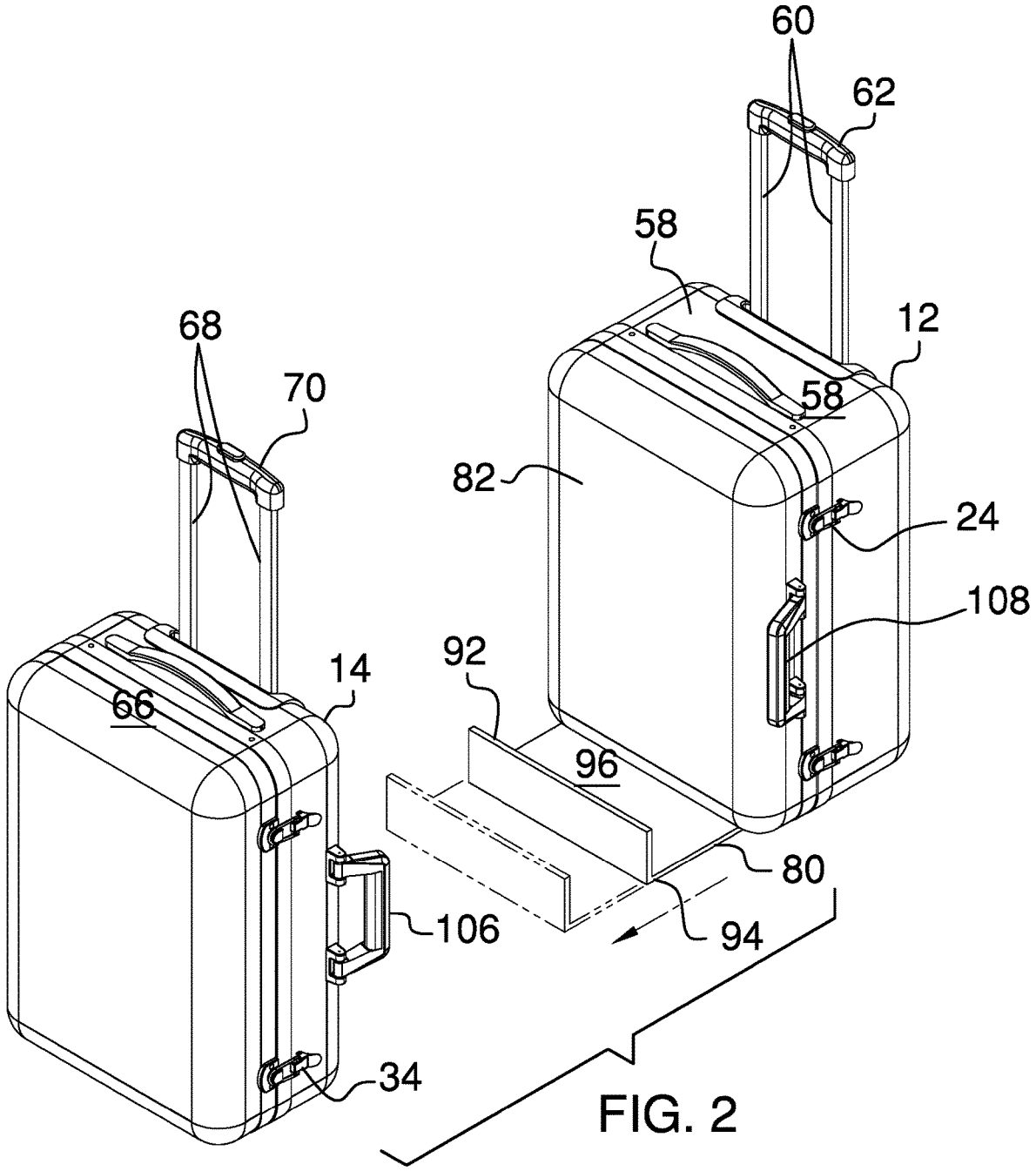
FIG. 2 is an isometric perspective view of an embodiment of the disclosure.

As shown in FIG. 2, the first handle 56 comprises a pair of first rods 60 and a second rod 62. Each first rod 60 is slidably coupled to the back 44 of the first suitcase 12. The second rod 62 is coupled to and extends between the first rods 60. The second rod 62 is configured to be grasped in the hand of the user to extend the first rods 60 from the first suitcase 12 and to urge the first suitcase 12 to roll on the first rollers 36 across the surface.

A second handle 64 is coupled to and is selectively extensible from the rear face 54 of the second suitcase 14 so that the handle is positioned above and perpendicular to an upper face 66 of the second suitcase 14. The second handle 64 is configured to be grasped in the hand of the user to urge the second suitcase 14 to roll on the second rollers 46 across the surface.

As shown in FIG. 2, the second handle 64 comprises a pair of third rods 68 and a fourth rod 70. Each third rod 68 is slidably coupled to the rear face 54 of the second suitcase 14. The fourth rod 70 is coupled to and extends between the third rods 68. The fourth rod 70 is configured to be grasped in the hand of the user to extend the third rods 68 from the second suitcase 14 and to urge the second suitcase 14 to roll on the second rollers 46 across the surface.

The first suitcase 12 comprises a first strap 72 that has opposing endpoints 74. Each opposing endpoint 74 is coupled to the top 58 of the first suitcase 12 so that the first strap 72 is configured to be grasped in the hand of the user to lift the first suitcase 12. The second suitcase 14 comprises a second strap 76 that has opposing ends 78. Each opposing end 78 is coupled to the upper face 66 of the second suitcase 14. The second strap 76 is configured to be grasped in the hand of the user to lift the second suitcase 14.

As shown in FIG. 2, a plate 80 is coupled to and is selectively extensible from the bottom 38 of the first suitcase 12 so that the plate 80 is selectively positionable in a retracted configuration and an extended configuration. In the retracted configuration, the plate 80 is stowed adjacent to the bottom 38. In the extended configuration, the plate 80 extends from and is perpendicular to a front 82 of the first suitcase 12. The plate 80 is configured to position an article, such as the second suitcase 14, so that the article is locomoted with the first suitcase 12.

Figure 6:
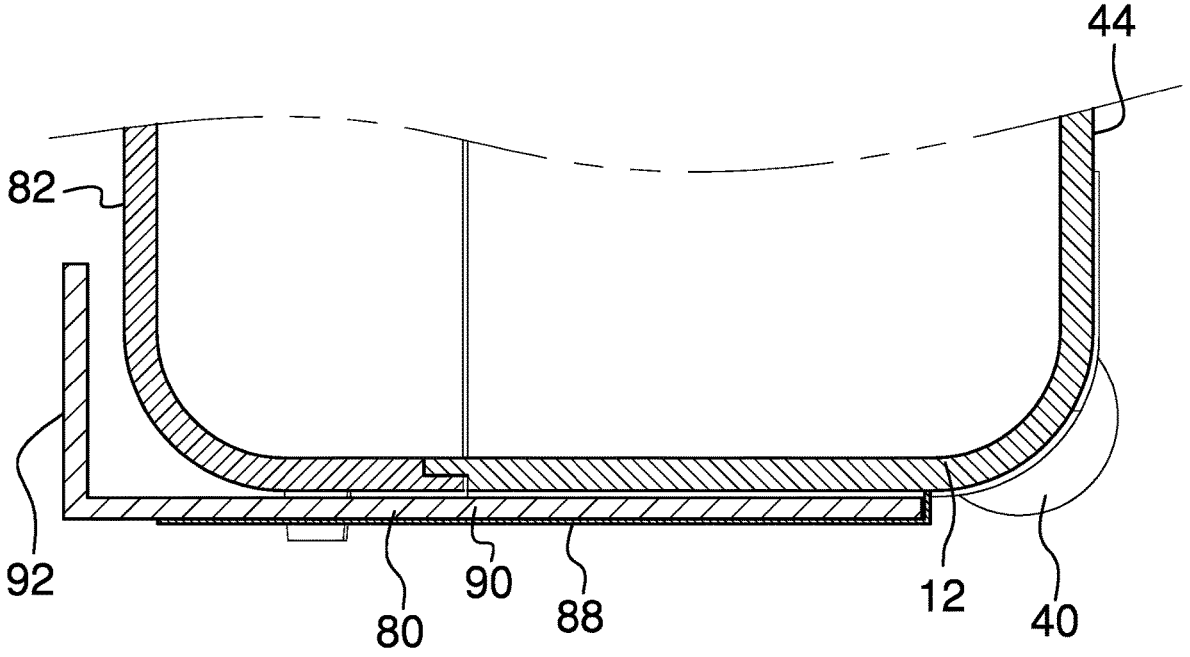
FIG. 6 is a cross-sectional view of an embodiment of the disclosure.

A track 84 is coupled to the bottom 38 of the first suitcase 12, as shown in FIG. 6. The plate 80 is positioned in and selectively slidable within the track 84. The track 84 comprises a pair of first panels 86 and a second panel 88. Each first panel 86 is coupled to and extends perpendicularly from the bottom 38 of the first suitcase 12. The second panel 88 is coupled to and extends between the first panels 86 distal from the bottom 38 to define a slot 90. The plate 80 is selectively extensible from the slot 90.

A lip 92 is coupled to and extends substantially perpendicularly from an edge 94 of the plate 80. The lip 92 is in substantial abutment with the front 82 of the first suitcase 12 with the plate 80 in the retracted configuration. The lip 92, with the plate 80 in the extended configuration, is configured to retain the article on the plate 80.

The lower face 48 of the second suitcase 14 is substantially complementary to an upper surface 96 of the plate 80. The user is positioned to place the second suitcase 14 on the upper surface 96 of the plate 80 between the lip 92 and the front 82 of the first suitcase 12.

A plurality of first connectors 98 is coupled to the first suitcase 12. A plurality of second connectors 100 is coupled to the second suitcase 14. The second connectors 100 are complementary to the first connectors 98 so that each second connector 100 is positioned to selectively couple to a respective first connector 98 to couple the second suitcase 14 to the first suitcase 12. The plurality of second connectors 100 comprises two second connectors 100 that are coupled singly to a first side 102 and a second side 104 of the second suitcase 14 proximate to the rear face 54.

Each second connector 100 comprises a second handgrip 106 that is pivotally coupled to the second suitcase 14. Each first connector 98 comprises a first handgrip 108 that is pivotally coupled to the first suitcase 12. The second handgrips 106 and the first handgrips are 108 complementarily magnetized so that each second handgrip 106 is positioned to selectively magnetically couple to a respective first handgrip 108, as shown in FIG. 1, to couple the second suitcase 14 to the first suitcase 12.

In use, when the user wishes to piggyback the second suitcase 14 on the first suitcase 12, the plate 80 is extended from the slot 90 and the second suitcase 14 is positioned on the upper surface 96 of the plate 80 between the lip 92 and the front 82 of the first suitcase 12. The user then brings each second handgrip 106 into proximity to a respective first handgrip 108 to magnetically couple the second handgrip 106 to the respective first handgrip 108 to couple the second suitcase 14 to the first suitcase 12. The first handle 56 then is extended, positioning the user to grasp the first handle 56, tilt the assembly 10 to elevate the plate 80 from the surface, and to roll the first suitcase 12 and second suitcase 14 upon the set of first wheels 40 across the surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rollable luggage assembly comprising:

a first suitcase;

a plurality of first rollers coupled to a bottom of the first suitcase;

a first handle coupled to and selectively extensible from a back of the first suitcase such that the first handle is positioned above and perpendicular to a top of the first suitcase wherein the first handle is configured for grasping in a hand of a user for urging the first suitcase for rolling on the first rollers across a surface;

a plate coupled to and selectively extensible from the bottom of the first suitcase such that the plate is selectively positionable in a retracted configuration wherein the plate is stowed adjacent to the bottom and an extended configuration wherein the plate extends from and is perpendicular to a front of the first suitcase wherein the plate is configured for positioning an article such that the article is locomoted with the first suitcase;

a second suitcase, the second suitcase having a lower face substantially complementary to an upper surface of the plate wherein the plate is positioned for supporting the second suitcase on the upper surface of the plate;

a plurality of first connectors coupled to the first suitcase; and a plurality of second connectors coupled to the second suitcase, the second connectors being complementary to the first connectors such that each second connector is positioned for selectively coupling to a respective first connector for coupling the second suitcase to the first suitcase, the plurality of second connectors comprising two second connectors coupled singly to a first side and a second side of the second suitcase proximate to the rear face, each second connector comprising a second handgrip pivotally coupled to the second suitcase, each first connector comprising a first handgrip pivotally coupled to the first suitcase, the second handgrips and the first handgrips being complementarily magnetized such that each second handgrip is positioned for selectively magnetically coupling to a respective first handgrip for coupling the second suitcase to the first suitcase.

2. The assembly of claim 1, further comprising:

the first suitcase being clamshell type;

a plurality of first fasteners coupled to a lower section of the first suitcase, the lower section being hingedly coupled to an upper section of the first suitcase; and a plurality of second fasteners coupled to the upper section of the first suitcase, the second fasteners being complementary to the first fasteners wherein each second fastener is positioned for selectively coupling to an associated first fastener for coupling the upper section to the lower section.

3. The assembly of claim 2, further including the second fastener and the associated first fastener comprising a first toggle latch.

4. The assembly of claim 1, further including the plurality of first rollers comprising a pair of first wheels, the first wheels being coupled singly proximate to bottom corners proximate to the back of the first suitcase.

5. The assembly of claim 1, further including the first handle comprising a pair of first rods and a second rod, each first rod being slidably coupled to the back of the first suitcase, the second rod being coupled to and extending between the first rods wherein the second rod is configured for grasping in the hand of the user for extending the first rods from the first suitcase and for urging the first suitcase for rolling on the first rollers across the surface.

6. The assembly of claim 1, further including a first strap having opposing endpoints, each opposing endpoint being coupled to the top of the first suitcase wherein the first strap is configured for grasping in the hand of the user for lifting the first suitcase.

7. The assembly of claim 1, further including a track coupled to the bottom of the first suitcase, the plate being positioned in and selectively slidable within the track.

8. The assembly of claim 7, further including the track comprising a pair of first panels and a second panel, each first panel being coupled to and extending perpendicularly from the bottom of the first suitcase, the second panel being coupled to and extending between the first panels distal from the bottom defining a slot wherein the plate is selectively extensible from the slot.

9. The assembly of claim 1, further including a lip coupled to and extending substantially perpendicularly from an edge of the plate such that the lip is in substantial abutment with the front of the first suitcase with the plate in the retracted configuration and wherein the lip with the plate in the extended configuration is configured for positioning the second suitcase between the lip and the front of the first suitcase retaining the second suitcase on the plate.

10. The assembly of claim 1, further comprising:

a plurality of first connectors coupled to the first suitcase; and a plurality of second connectors coupled to the second suitcase, the second connectors being complementary to the first connectors such that each second connector is positioned for selectively coupling to a respective first connector for coupling the second suitcase to the first suitcase.

11. The assembly of claim 1, further comprising:

the second suitcase being clamshell type;

a plurality of third fasteners coupled to a bottom section of the second suitcase, the bottom section being hingedly coupled to an upward section of the second suitcase; and a plurality of fourth fasteners coupled to the upward section of the second suitcase, the fourth fasteners being complementary to the third fasteners wherein each fourth fastener is positioned for selectively coupling to an associated third fastener for coupling the upward section to the bottom section.

12. The assembly of claim 11, further including the fourth fastener and the associated third fastener comprising a second toggle latch.

13. The assembly of claim 1, further including a plurality of second rollers coupled to the lower face of the second suitcase.

14. The assembly of claim 13, further including the plurality of second rollers comprising a pair of second wheels, the second wheels being coupled singly proximate to lower face corners proximate to a rear face of the second suitcase.

15. The assembly of claim 14, further including a second handle coupled to and selectively extensible from the rear face of the second suitcase such that the handle is positioned above and perpendicular to an upper face of the second suitcase wherein the second handle is configured for grasping in the hand of the user for urging the second suitcase for rolling on the second rollers across the surface, the second handle comprising a pair of third rods and a fourth rod, each third rod being slidably coupled to the rear face of the second suitcase, the fourth rod being coupled to and extending between the third rods wherein the fourth rod is configured for grasping in the hand of the user for extending the third rods from the second suitcase and for urging the second suitcase for rolling on the second rollers across the surface.

16. The assembly of claim 1, further including a second strap having opposing ends, each opposing end being coupled to an upper face of the second suitcase wherein the second strap is configured for grasping in the hand of the user for lifting the second suitcase.

17. A rollable luggage assembly comprising:

a first suitcase, the first suitcase being clamshell type;

a plurality of first fasteners coupled to a lower section of the first suitcase, the lower section being hingedly coupled to an upper section of the first suitcase;

a plurality of second fasteners coupled to the upper section of the first suitcase, the second fasteners being complementary to the first fasteners wherein each second fastener is positioned for selectively coupling to an associated first fastener for coupling the upper section to the lower section, the second fastener and the associated first fastener comprising a first toggle latch;

a plurality of first rollers coupled to a bottom of the first suitcase, the plurality of first rollers comprising a pair of first wheels, the first wheels being coupled singly proximate to bottom corners proximate to a back of the first suitcase;

a first handle coupled to and selectively extensible from the back of the first suitcase such that the first handle is positioned above and perpendicular to a top of the first suitcase wherein the first handle is configured for grasping in a hand of a user for urging the first suitcase for rolling on the first rollers across a surface, the first handle comprising a pair of first rods and a second rod, each first rod being slidably coupled to the back of the first suitcase, the second rod being coupled to and extending between the first rods wherein the second rod is configured for grasping in the hand of the user for extending the first rods from the first suitcase and for urging the first suitcase for rolling on the first rollers across the surface;

a first strap having opposing endpoints, each opposing endpoint being coupled to the top of the first suitcase wherein the first strap is configured for grasping in the hand of the user for lifting the first suitcase;

a plate coupled to and selectively extensible from the bottom of the first suitcase such that the plate is selectively positionable in a retracted configuration wherein the plate is stowed adjacent to the bottom and an extended configuration wherein the plate extends from and is perpendicular to a front of the first suitcase wherein the plate is configured for positioning an article such that the article is locomoted with the first suitcase;

a track coupled to the bottom of the first suitcase, the plate being positioned in and selectively slidable within the track, the track comprising a pair of first panels and a second panel, each first panel being coupled to and extending perpendicularly from the bottom of the first suitcase, the second panel being coupled to and extending between the first panels distal from the bottom defining a slot wherein the plate is selectively extensible from the slot;

a lip coupled to and extending substantially perpendicularly from an edge of the plate such that the lip is in substantial abutment with the front of the first suitcase with the plate in the retracted configuration and wherein the lip with the plate in the extended configuration is configured for retaining the article on the plate;

a second suitcase, the second suitcase having a lower face substantially complementary to an upper surface of the plate wherein the user is positioned for placing the second suitcase on the upper surface of the plate between the lip and the front of the first suitcase, the second suitcase being clamshell type;

a plurality of third fasteners coupled to a bottom section of the second suitcase, the bottom section being hingedly coupled to an upward section of the second suitcase;

a plurality of fourth fasteners coupled to the upward section of the second suitcase, the fourth fasteners being complementary to the third fasteners wherein each fourth fastener is positioned for selectively coupling to an associated third fastener for coupling the upward section to the bottom section, the fourth fastener and the associated third fastener comprising a second toggle latch;

a plurality of second rollers coupled to the lower face of the second suitcase, the plurality of second rollers comprising a pair of second wheels, the second wheels being coupled singly proximate to lower face corners proximate to a rear face of the second suitcase;

a second handle coupled to and selectively extensible from the rear face of the second suitcase such that the handle is positioned above and perpendicular to an upper face of the second suitcase wherein the second handle is configured for grasping in the hand of the user for urging the second suitcase for rolling on the second rollers across the surface, the second handle comprising a pair of third rods and a fourth rod, each third rod being slidably coupled to the rear face of the second suitcase, the fourth rod being coupled to and extending between the third rods wherein the fourth rod is configured for grasping in the hand of the user for extending the third rods from the second suitcase and for urging the second suitcase for rolling on the second rollers across the surface;

a second strap having opposing ends, each opposing end being coupled to the upper face of the second suitcase wherein the second strap is configured for grasping in the hand of the user for lifting the second suitcase;

a plurality of first connectors coupled to the first suitcase; and a plurality of second connectors coupled to the second suitcase, the second connectors being complementary to the first connectors such that each second connector is positioned for selectively coupling to a respective first connector for coupling the second suitcase to the first suitcase, the plurality of second connectors comprising two second connectors coupled singly to a first side and a second side of the second suitcase proximate to the rear face, each second connector comprising a second handgrip pivotally coupled to the second suitcase, each first connector comprising a first handgrip pivotally coupled to the first suitcase, the second handgrips and the first handgrips being complementarily magnetized such that each second handgrip is positioned for selectively magnetically coupling to a respective first handgrip for coupling the second suitcase to the first suitcase.

* * * * *